US008188952B1

(12) United States Patent
Orlando et al.

(10) Patent No.: US 8,188,952 B1
(45) Date of Patent: May 29, 2012

(54) SYSTEM AND METHOD FOR REDUCING LCD FLICKER

(75) Inventors: Richard V. Orlando, Los Gatos, CA (US); Trevor A. Blyth, Sandy, UT (US)

(73) Assignee: Alta Analog, Inc., San Jose, CA (US)

( * ) Notice: Subject to any disclaimer, the term of this patent is extended or adjusted under 35 U.S.C. 154(b) by 1237 days.

(21) Appl. No.: 11/937,419

(22) Filed: Nov. 8, 2007

(51) Int. Cl.
*G09G 3/36* (2006.01)

(52) U.S. Cl. ..... 345/87; 345/89; 345/211

(58) Field of Classification Search ..... 345/87–100, 345/204, 211–213
See application file for complete search history.

(56) References Cited

U.S. PATENT DOCUMENTS 7,050,027 B1 * 5/2006 Macrae ..... 345/87
7,679,592 B2 * 3/2010 Nakamura ..... 345/92
2002/0180680 A1 * 12/2002 Moon ..... 345/89
2006/0164371 A1 * 7/2006 Nakamura ..... 345/98
2006/0231794 A1 * 10/2006 Sakaguchi et al. ..... 252/299.61

* cited by examiner

*Primary Examiner* — Kimnhung Nguyen
(74) *Attorney, Agent, or Firm* — Fernandez & Associates, LLP

(57) ABSTRACT

The present invention relates to a method and a system of reducing flicker in a liquid crystal display (LCD). The LCD produces a display based on a video signal. A gamma curve of the LCD includes multiple gamma reference voltages corresponding to multiple gray scale values of the video signal. The method (and a system implementing the method) includes determining the gamma curve of the LCD for producing a predetermined luminance performance, driving the LCD by a test pattern having one of the multiple gray scale values, measuring a flicker of the LCD driven by the test pattern, and adjusting a gamma reference voltage in the gamma curve based on the flicker measurement to minimize the flicker of the LCD where the gamma reference voltage corresponds to the gray scale value in the gamma curve.

13 Claims, 5 Drawing Sheets

SYSTEM AND METHOD FOR REDUCING LCD FLICKER

CROSS-REFERENCE TO RELATED APPLICATIONS

This application relates to U.S. application No. 60/713,870 entitled "Gamma reference Voltage Generator" filed on Sep. 1, 2005, which is incorporated herein by reference.

BACKGROUND OF THE INVENTION

1. Field of the Invention

The invention related generally to the field of electronic displays and more particularly to Color Liquid Crystal Displays (LCDs).

2. Background of the Related Art

LCDs operate on the principle that an electric field, when applied to a LCD pixel, will cause the liquid crystals in the LCD pixel to move or rotate. A LCD has an array of LCD pixels (i.e., pixel array), the amount of light which is passed through each LCD pixel is a function of the amount of rotation of the liquid crystals in the LCD pixel. For example, each LCD pixel is constructed such that minimum amount of light passes through the liquid crystals when the voltage (therefore the electric field) applied to the LCD pixel is zero. Typically, in active matrix LCD panels, the rotation of liquid crystal in each LCD pixel is controlled by applying a row voltage and a column voltage during the scanning of the LCD in a scan mode well known in the art. As the LCD is driven in the scanned mode, a LCD pixel at the intersection of the currently selected row and column is rotated based on a video signal to produce the image displayed on the LCD. In a typical example, while the LCD pixel is selected, the row voltage is constant and the column voltage is determined by the pixel based digital data (i.e., the digital form of the video signal) controlling the LCD pixel. The transfer function relationship between the digital data to the analog voltage (i.e., the analog form of the video signal, also called the column voltage) applied to the column of the LCD pixel in the pixel array is called the gamma transfer function by those skilled in the art. The gamma transfer function is column based and is controlled by the circuitry in the column drivers based on externally supplied gamma reference voltages.

The array of LCD pixels in the LCD are constantly lit by a backlight. The constancy of the backlight removes the type of flicker commonly found in CRT (cathode ray tube) screens due to phosphors pulsing with each refresh cycle. Instead, as illustrated by a LCD pixel (100) shown in FIG. 1, the liquid crystals (101) is sandwiched between an upper plate electrode (102) and a lower plate electrode (103) with grooves (104) cut in orthogonal directions. These grooves (104) influence the electric field (not shown) between the upper plate electrode (102) and the lower plate electrode (103) to align the LCD crystals (101) to form channels (105) for the backlight (not shown) to pass through the liquid crystals (101) to the front of the LCD.

As described above, the amount of light emitted through the LCD pixel (100) depends upon the orientation of the liquid crystals (101) in the LCD pixel (100) and is proportional to the voltage (106) applied to the LCD pixel (100). FIG. 2 shows a pixel element (200) including the LCD pixel (100) and the driving circuit in a pixel array of an exemplary LCD (not shown). The LCD pixel (100) in FIG. 2 is shown in a schematic form representing the structure of the LCD pixel (100) shown in FIG. 1. The driving circuit includes a switch (205) (e.g., a transistor switch) and conductors carrying the column voltage (204) and row voltage (207). The lower plate electrode (103) is typically connected to a common node across the pixel array. The voltage at this common node is commonly called Vcom (202). The upper plate electrode (102) is connected to the switch (205). The LCD pixel (201) is generally associated with a capacitance (203). The row voltage (206) is applied to the gate (206) of the switch (205) and controls the conductivity of the switch (205). The switch (205) in turn applies the column voltage (204) to the LCD pixel (100) as controlled by the row voltage (207) through the gate (206). The row voltage (207) and the column voltage (204) are typically applied across a grid of conductors overlaying the pixel array of the LCD.

As the pixel element (200) is selected during the scanning of the LCD, the gate (206) is driven by the row voltage (207) with a voltage swing, for example, from −5V to 20V. The video source driving the LCD supplies a stream of pixel based digital data (i.e., the digital form of the video signal) as the pixel array is scanned. The pixel based digital data is translated into analog voltage (i.e., the analog form of the video signal) carrying the video signal, for example, with an analog video voltage swing ranging from 0V to 10V. The analog video signal is applied as the column voltage (204) during the scanning of the LCD. The intensity information represented by the digital data is realized as the video signal is applied across the LCD pixel. In some examples, the common node Vcom (202) is connected to the backplane of the LCD panel, which is held at ground voltage (i.e., 0V). While this configuration is functional, the LCD panel lifetime may be reduced. One such mechanism that reduces LCD panel lifetime is explained here. As shown in FIG. 1, with Vcom (202) being held at ground and the voltage (106) across the LCD pixel (101) varies from 0V to 10V, there is a substantial average DC voltage level of 5V being applied across each LCD pixel (101). This average DC voltage level causes charge storage, or memory effect of the LCD pixel (101) known to those skilled in the art. In the long term, this memory effect degrades the LCD pixel (101) by electroplating ion impurities onto an electrode of the LCD pixel (101). This contributes to image retention problem, commonly known as a sticking image.

As shown in FIG. 1, the structure of the LCD pixel (100) is symmetrical. The amount of liquid crystal rotation is determined by the magnitude of the voltage (106). For example, in a normally black LCD panel, the pixel element (200) is constructed such that the LCD pixel (100) has minimum brightness when the voltage (106) is zero. Other common configurations include a normally white LCD panel, in which case maximum brightness is achieved when the voltage (106) is minimum (e.g., zero). In the normally black configuration, the voltage (106) applied to the liquid crystals (101) can have either a positive or a negative polarity with same magnitude to align the liquid crystals (101) to produce nominally the same brightness for the LCD pixel (100). It is known in the art to capitalize on this aspect by connecting the lower plate electrode (103) through the common node Vcom (202) to a voltage generator circuitry to set the Vcom (202) at the midpoint of the video signal voltage swing (e.g., 5V in the middle of 0V to 10V). Accordingly, the LCD pixel (101) in the pixel element (200) will have a nominal minimum brightness when the column voltage (204) carrying the video signal is driven to the Vcom (202) voltage level (e.g., 5V). In this configuration, the video signal carried by the column voltage (204) is converted to drive the voltage (106) in a bipolar format such that the voltage of the upper plate electrode (103) swings 5V above and 5V below the common voltage Vcom (202) (e.g., 5V) of the lower plate electrode (103). The converted video signal produces full brightness for the LCD pixel (100) by driving the voltage (106) to opposite polarities in alternating positive and negative fields of the scan mode. This configuration creates a net zero average DC voltage level on the LCD pixel (100) and eliminates the aging and image retention issues.

However, it is known in the art that a LCD panel in this configuration will flicker (i.e., producing alternating light intensities) due to manufacturing variations. For example, the column voltage (204) to produce minimum brightness for the LCD pixel (100) may be 5.5V instead of 5V due to manufacturing variations in the construction of the LCD panel, such as variations in the geometries of the pixel array (not shown), the conductor grid (e.g., carrying the column voltage (204) and/or the row voltage (207)), the pixel element (200), the LCD pixel (100), the driving circuitries, etc. If the column voltage (204) swings between 0V and 10V, the effective full-scale voltage for the video signal in the bipolar format will be different between the positive and negative fields. In one field, the effective full-scale voltage will be 4.5V and in the other field, the effective full-scale voltage will be 5.5V. This difference in effective full-scale voltages translates to a difference in brightness between the positive and negative fields, which is typically experienced as flicker (i.e., light pattern of alternating intensities).

Due to the variations in the construction of each LCD panel through the manufacturing process, while the Vcom (202) is held at the midpoint of the analog video voltage swing, the column voltage (204) to produce minimum brightness for the LCD pixel (100) can differ from panel to panel or across a single panel. Original Equipment Manufacturers using the LCD panel as their system component must therefore adjust each of the panels to eliminate flicker. For LCD with a small screen size where the backplane can be considered a low-impedance ground, a single potentiometer can be added for common voltage adjustment, such as the adjustment of Vcom (202) to compensate for the variation. Traditionally, this is achieved by using mechanical potentiometers and the adjustment is labor intensive. Furthermore, this adjustment can only be made at one gray scale level of the video signal. For example, a flicker video pattern corresponding to a specific gray scale level is displayed on the LCD, and the potentiometer is adjusted until the flicker is minimized. It is known in the art that the required adjustment in Vcom (202) will be different at each gray scale level, therefore adjusting the Vcom (202) at only one gray scale level is a compromise that still results in flicker at other gray scale levels. Since the Vcom (202) is a common voltage for the video signal at all gray scale levels, using Vcom trimming cannot eliminate flicker throughout the entire gray scale range of the video signal.

SUMMARY

In general, in one aspect, the present invention relates to a method of reducing flicker in a liquid crystal display (LCD). The LCD produces a display based on a video signal. A gamma curve of the LCD includes multiple gamma reference voltages corresponding to multiple gray scale values of the video signal. The method includes determining the gamma curve of the LCD for producing a predetermined luminance performance, driving the LCD by a test pattern having one of the multiple gray scale values, measuring a flicker of the LCD driven by the test pattern, and adjusting a gamma reference voltage in the gamma curve based on the flicker measurement to minimize the flicker of the LCD where the gamma reference voltage corresponds to the gray scale value in the gamma curve.

In general, in one aspect, the present invention relates to a system for reducing flicker in a liquid crystal display (LCD). The LCD produces a display based on a video signal. A gamma curve of the LCD includes multiple gamma reference voltages corresponding to multiple gray scale values of the video signal. The system includes means for generating the gamma curve for producing a predetermined luminance performance, means for driving the LCD by a test pattern having one of the multiple gray scale values, means for measuring a flicker of the LCD driven by the test pattern, and means for adjusting a gamma reference voltage in the gamma curve based on the flicker measurement minimize the flicker of the LCD where the gamma reference voltage corresponds to the gray scale value in the gamma curve.

Other aspects and advantages of the invention will be apparent from the following description and the appended claims.

DETAILED DESCRIPTION

Figure 1:
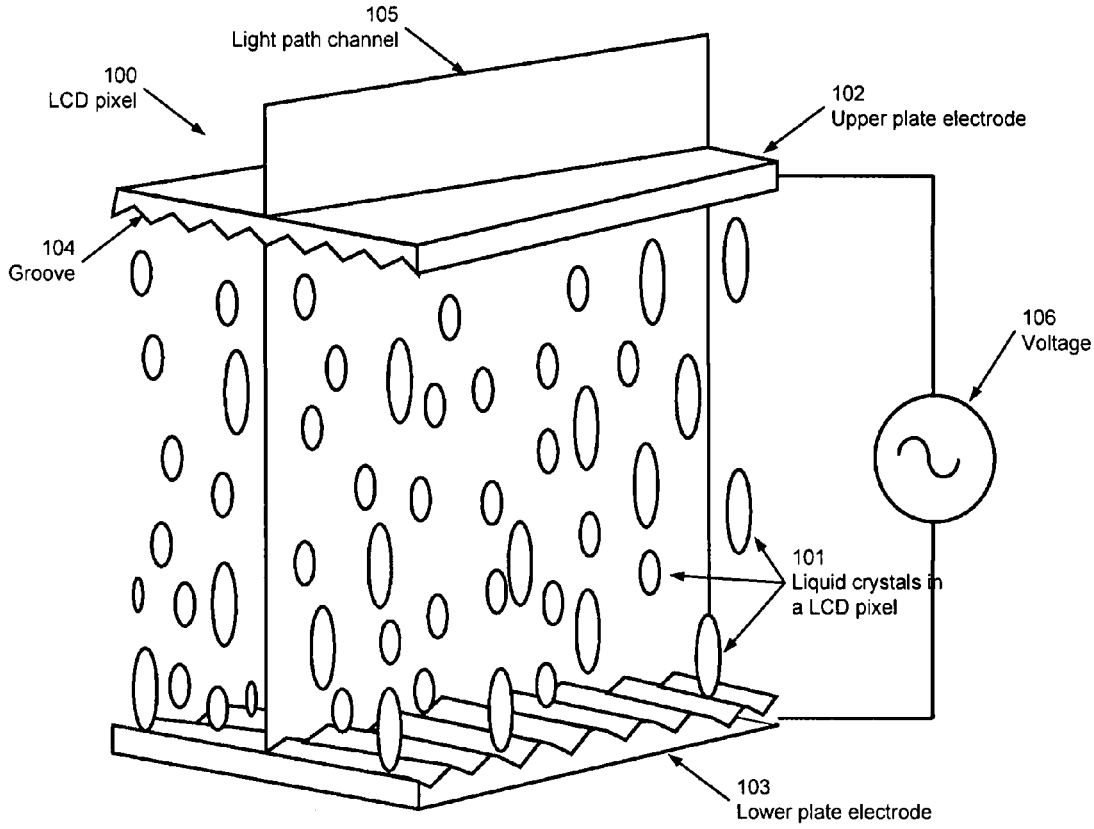
FIG. 1 shows a diagram of a LCD pixel in cross sectional view.
Figure 2:
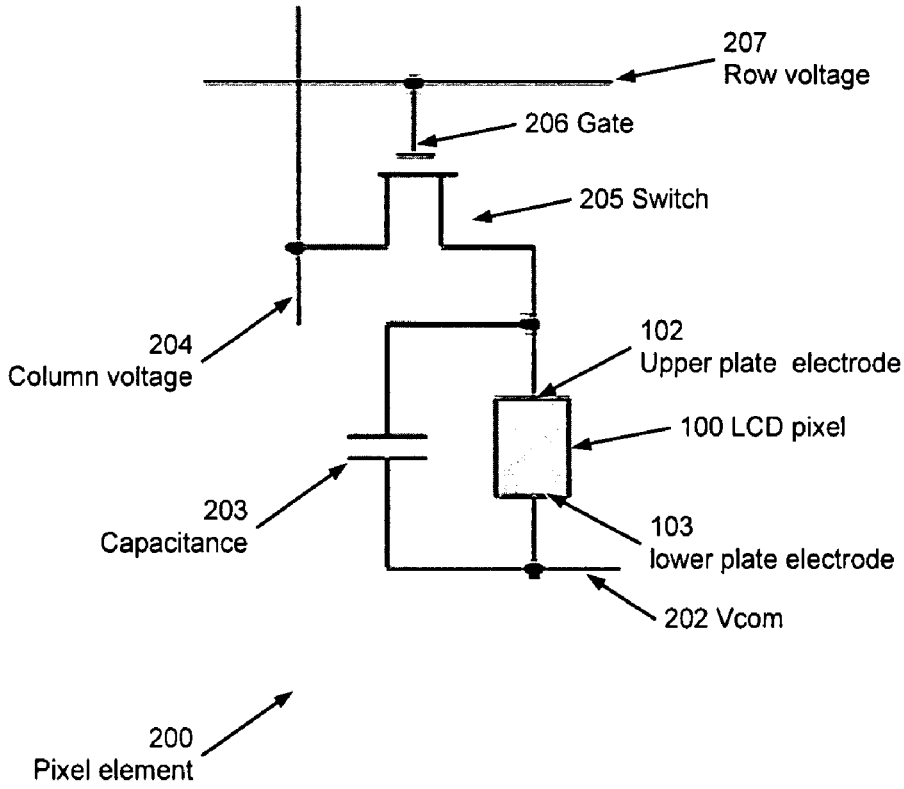
FIG. 2 shows a schematic diagram for a pixel element of a pixel array.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. In other instances, well-known features have not been described in detail to avoid obscuring the invention.

A gamma reference voltage of a display device, such as a LCD, is typically determined for each gray scale value in the video signal range to achieve desired perceived linear luminance. In general, in one aspect, the present invention relates to a method where the flicker in the panel is reduced by further adjustment of the gamma reference voltage at each gray scale level instead of adjusting the Vcom voltage. This technique allows optimized flicker reduction throughout the gray scale levels.

In this approach, the Vcom voltage is set to an initial value producing an initial gray scale value (e.g., gray scale 128). A gray scale value under test is then selected and a flicker pattern for the gray scale value under test is displayed on the panel. A gamma reference voltage for this gray scale level is further adjusted to find the voltage setting which results in the smallest amount of flicker. The flicker is measured by a photo sensor mounted on the front of the display during the test operation. Multiple sensors can be used to find the minimum flicker across the entire display area. The procedure is then repeated at each of the gray scale levels to minimize flicker throughout the entire gray scale range of the video signal.

Figure 3:
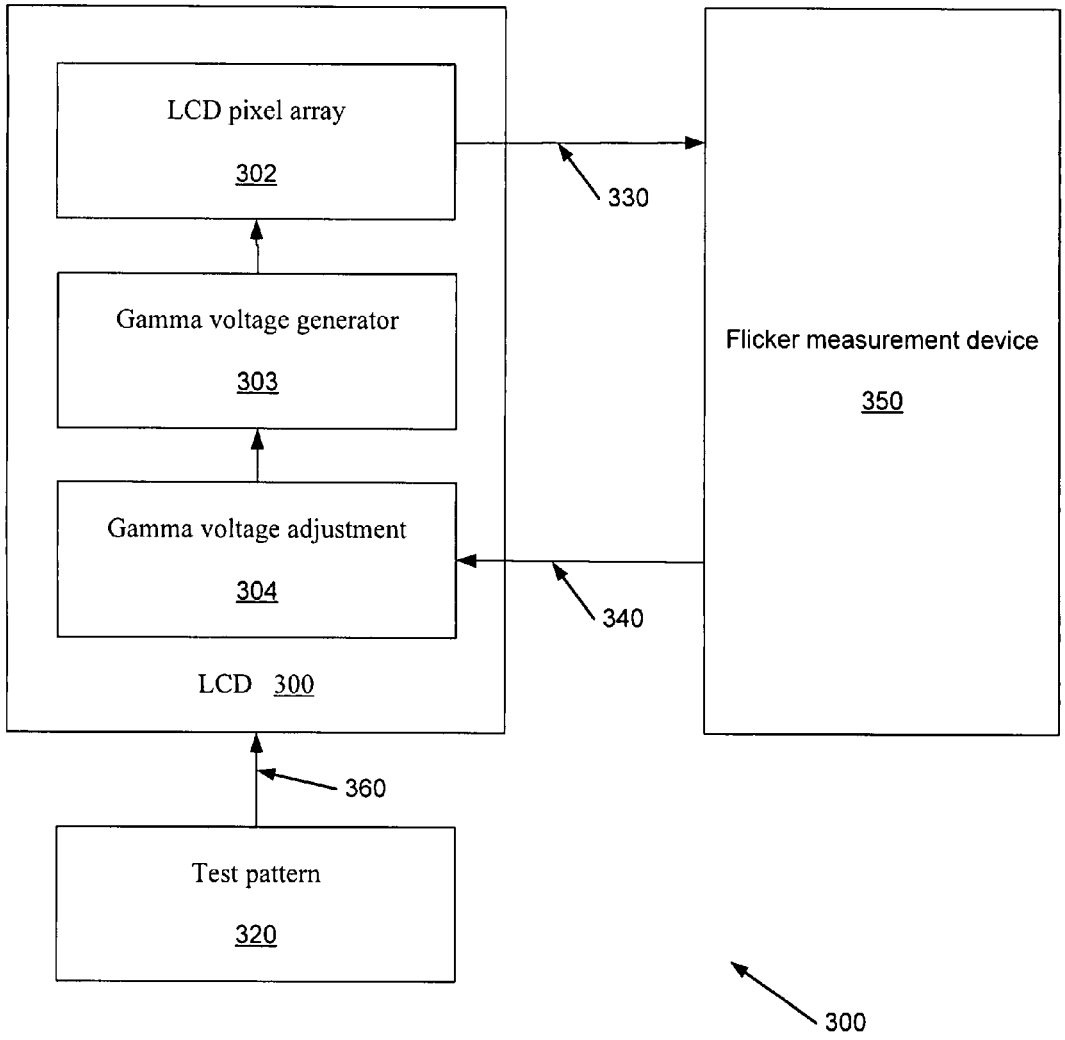
FIG. 3 shows a system for reducing LCD flicker.

FIG. 3 shows a system for reducing LCD flicker. Here, the LCD (300) includes the LCD pixel array (302), the gamma voltage generator (303) for generating multiple gamma reference voltages, and the gamma voltage adjustment module (304). The LCD (303) produces a display image based on input video signal (360). The input video signal (360) may be processed within the LCD (300) into video signals with different formats as described above, such as the digital format, analog format, bipolar format, etc. The gamma reference voltages can be generated by the gamma voltage generator (303), for example, using the method and system disclosed in U.S. application No. 60/713,870 entitled "Gamma reference Voltage Generator" filed on Sep. 1, 2005, which is incorporated herein by reference. These gamma reference voltages are used to drive the LCD pixel array (302) to achieve desired luminance performance, such as luminance linearity. The LCD (300) also includes the gamma voltage adjustment module (304) which adjusts the gamma reference voltages based on flicker measurement information (340) from the flicker measurement device (350). The flicker measurement information (340) is minimized during the gamma voltage adjustment to eliminate or minimize the flicker (330). The flicker measurement device (350) may be a photo sensor that measures the flicker (330) from one location or multiple locations of the LCD pixel array (302) to produce a signal (e.g., electrical signal) proportional to the alternating intensities of the flicker light pattern. The LCD (300) is driven by a test pattern (320) supplied through the video signal input (360) for performing the flicker measurement (e.g., using the flicker measurement device (350)) and the flicker adjustment (e.g., using the gamma voltage adjustment module (304)) based on flicker measurement information (340). The test pattern (320) may be a gray scale pattern corresponding to a gray scale value. The flicker measurement and adjustment may be performed for multiple gray scale value within the range of the video signal (360). The flicker (330) may be minimized for all gray scale values throughout the range of the video signal (360).

Figure 4:
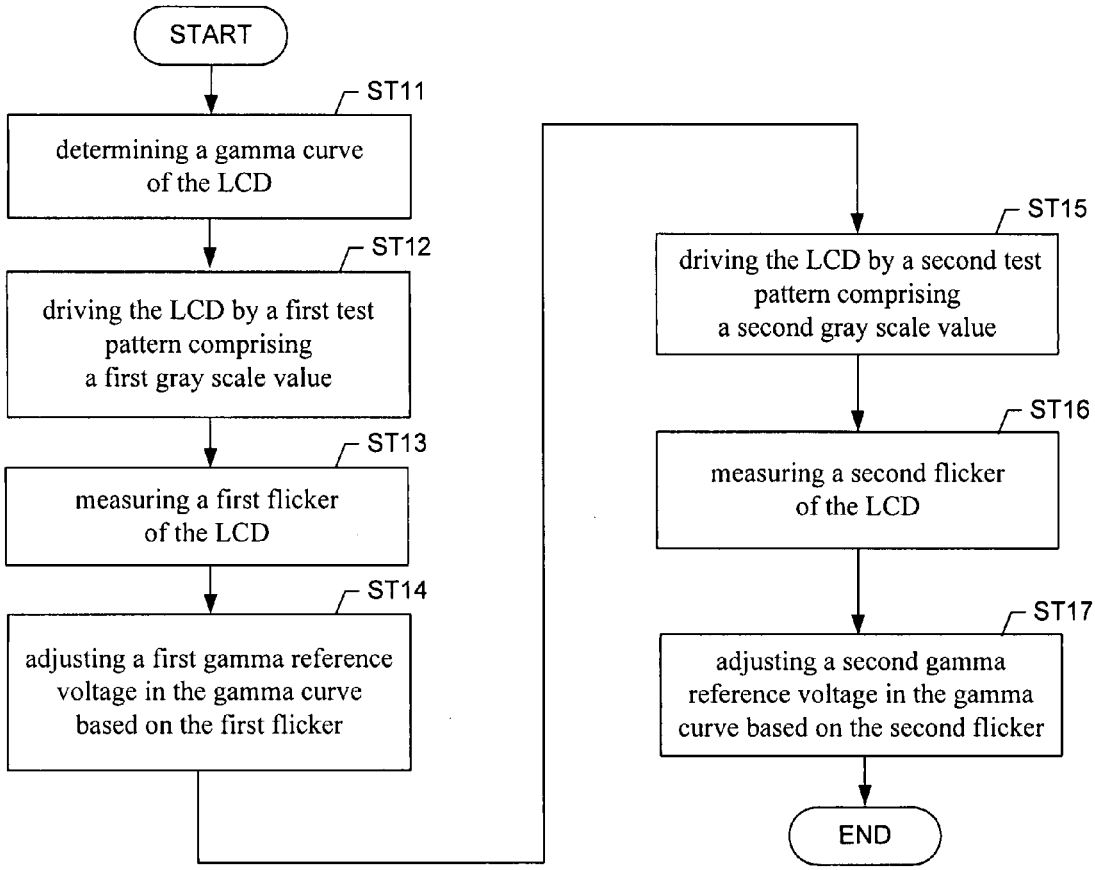
FIG. 4 shows a flow chart of a method for reducing LCD flicker.

FIG. 4 shows a flow chart of the method for reducing LCD flicker. Initially, a gamma curve of the LCD (e.g., the LCD (302) as shown in FIG. 3) is determined for producing a predetermined luminance performance (ST11). Typically the luminance performance is measured in terms of perceived linearity. The gamma curve includes multiple gamma reference voltages (e.g., generated by the gamma reference voltage generator (303) as shown in FIG. 3) corresponding to multiple gray scale values of the video signal (e.g., the input video signal (360) as shown in FIG. 3) driving the LCD. The gamma reference voltages can be generated, for example, using the method and system disclosed in U.S. application No. 60/713,870 entitled "Gamma reference Voltage Generator" filed on Sep. 1, 2005, which is incorporated herein by reference. In an exemplary configuration, the input video signal driving the LCD is converted into an analog voltage (such as the voltage (106) as shown in FIG. 1) having opposite polarities in alternating positive and negative display fields. The LCD is then driven by a first test pattern (e.g., the test pattern (320) as shown in FIG. 3) which includes a first gray scale value selected from the multiple gray scale values (ST12). A brightness difference between the positive and negative display fields causes flicker of the LCD. A first flicker of the LCD driven by the first test pattern is measured, for example, using photo sensors (e.g., the flicker measurement device (350) as shown in FIG. 3) positioned facing the front of the LCD (ST13). In one example, the flicker (e.g., the flicker (330) as shown in FIG. 3) is measured at one location of the LCD. In other examples, the flicker is measured at multiple locations and an average value is determined from the multiple measurements. Based on the measured flicker, a first gamma reference voltage corresponding to the first gray scale value in the gamma curve is adjusted (ST14) (e.g., by the gamma voltage adjustment module (304) as shown in FIG. 3). The adjustment is made to minimize the measured flicker from the LCD at the first gray scale value. In addition, these procedures can be optionally repeated for a different gray scale value. The LCD is driven by a second test pattern which includes a second gray scale value selected from the multiple gray scale values (ST15). A second flicker of the LCD driven by the second test pattern is measured (ST16). Based on the measured flicker, a second gamma reference voltage corresponding to the second gray scale value in the gamma curve is adjusted (ST17). The adjustment is made to minimize the measured flicker from the LCD at the second gray scale value. This adjustment is made independently of the previous adjustment to minimize the measured flicker at the first gray scale value.

Figure 5:
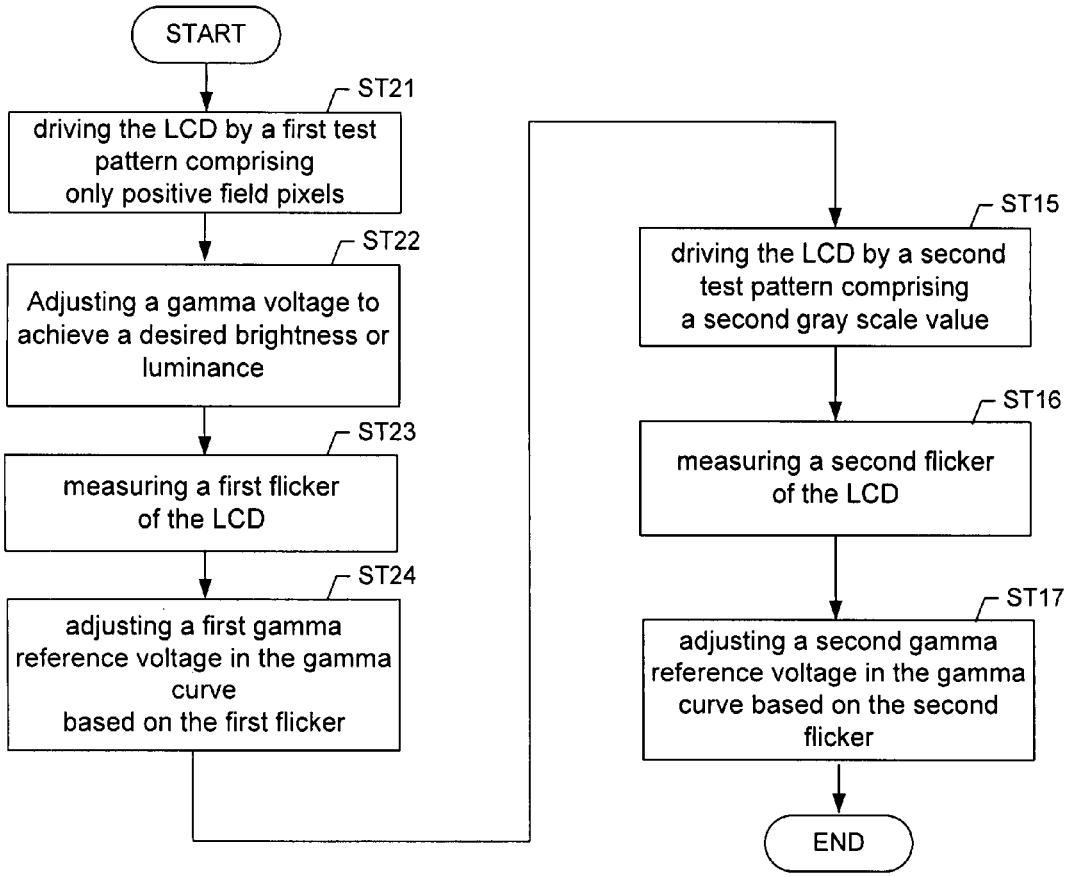
FIG. 5 shows a flow chart of an alternative approach for flicker reduction.

FIG. 5 shows a flow chart of an alternative approach for flicker reduction. In this approach, the flicker reduction can be performed in combination with the gamma curve calibration by measuring the brightness or luminance of each of the positive and negative fields independently. For each gray scale level, the gamma transfer function may include a gamma voltage pair of a first gamma voltage for the positive field and a second gamma voltage for the negative field. Initially, a desired gamma transfer function (or a gamma curve) is determined (ST20). A particular gray scale is then selected (ST21). A first test pattern with the particular gray scale may be employed that only displays the positive field pixels, i.e., the gray scale level of all negative field pixels are black (ST22). The first gamma reference voltage for the positive field is then adjusted for the particular gray scale to achieve a desired brightness or luminance according to the gamma curve (ST23). A second test pattern with the same gray scale is then employed that only displays the negative field pixels, i.e., the gray scale level of all positive field pixels are black (ST24). The second gamma reference voltage for the negative field is then adjusted for the particular gray scale to achieve the same desired brightness or luminance (ST25). In some examples, the first gamma voltage and the second gamma voltage may be adjusted in the opposite direction to achieve the same brightness for the first test pattern and the second test pattern. In other examples, they may be adjusted in the same direction. Accordingly, the two brightness are the same and flicker is reduced or eliminated at this particular gray scale level. Additional gray scale levels are then selected for the same procedure to be performed. After the procedure is performed for all the gray scale levels of the gamma curve, the LCD panel is calibrated to the gamma curve (the mapping function from gray scale to desired luminance) at the same time as flicker is eliminated.

Although the examples given above describe a normally black LCD panel, one skilled in the art will recognize the invention can be practiced with other common configurations such as a normally white LCD panel. It will be understood from the foregoing description that various modifications and changes may be made in the preferred and alternative embodiments of the present invention without departing from its true spirit. For example, embodiments may include subset or superset of the examples described, the method may be performed in a different sequence, the components provided may be integrated or separate, the devices included herein may be manually and/or automatically activated to perform the desired operation. The activation may be performed as desired and/or based on data generated, conditions detected and/or other suitable means.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method of reducing flicker in a liquid crystal display (LCD), wherein the LCD produces a display based on a video signal, the method comprising:

determining a gamma curve of the LCD for producing a predetermined luminance performance, wherein the gamma curve comprises a plurality of gamma reference voltages corresponding to a plurality of gray scale values of the video signal;

driving the LCD by a first test pattern comprising a first gray scale value of the plurality of gray scale values;

measuring a first flicker of the LCD driven by the first test pattern;

adjusting a first gamma reference voltage in the gamma curve based on the first flicker, wherein the first gamma reference voltage corresponds to the first gray scale value;

driving the LCD by a second test pattern comprising a second gray scale value of the plurality of gray scale values;

measuring a second flicker of the LCD driven by the second test pattern; and adjusting a second gamma reference voltage in the gamma curve based on the second flicker, wherein the second gamma reference voltage corresponds to the second gray scale value.

2. The method of claim 1, wherein the video signal is converted to an analog voltage comprising alternating polarities corresponding to alternating positive and negative display fields, wherein a brightness difference between the positive and negative display fields causes the first flicker.

3. The method of claim 1, wherein the first flicker is measured at a plurality of locations about the LCD.

4. The method of claim 1, wherein the first gamma reference voltage is adjusted until the first flicker is minimized over a range of first gamma reference voltage values.

5. The method of claim 4, wherein the second gamma reference voltage is adjusted independent of the first gamma reference voltage.

6. A method of reducing flicker in a liquid crystal display (LCD), wherein the LCD produces a display based on a video signal, the method comprising:

determining a gamma curve of the LCD for producing a predetermined luminance performance, wherein the gamma curve comprises a plurality of gamma reference voltages corresponding to a plurality of gray scale values of the video signal;

driving the LCD by a plurality of test patterns each comprising a predetermined gray scale value of the plurality of gray scale values;

measuring a plurality of flicker magnitudes of the LCD, wherein each of the plurality of flicker magnitudes is measured with the LCD driven by a selected test pattern of the plurality of test patterns; and adjusting a plurality of gamma reference voltages in the gamma curve based on the plurality of flicker magnitudes, wherein each adjusted gamma reference voltage corresponds to the predetermined gray scale value of a corresponding flicker magnitude.

7. A method of reducing flicker in a liquid crystal display (LCD), wherein the LCD produces a display based on a video signal and a scan mode comprising a positive field and a negative field, the method comprising:

determining a gamma curve of the LCD for producing a predetermined luminance performance, wherein the gamma curve comprises a gamma reference voltage pair corresponding to a gray scale value of the video signal, wherein the gamma reference voltage pair comprises a first gamma voltage for the positive field and a second gamma voltage for the negative field;

driving the LCD by a first test pattern comprising the gray scale value in the positive field, wherein the first test pattern comprises black gray scale value in the negative field;

adjusting the first gamma reference voltage to achieve a brightness according to the gamma curve;

driving the LCD by a second test pattern comprising the gray scale value in the negative field, wherein the second test pattern comprises black gray scale value in the positive field; and adjusting the second gamma reference voltage to achieve the brightness according to the gamma curve.

8. A system for reducing flicker in a liquid crystal display (LCD), wherein the LCD produces a display based on a video signal, the system comprising:

means for generating a plurality of gamma reference voltages corresponding to a plurality of gray scale values of the video signal, wherein the plurality of gamma reference voltages form a gamma curve of the LCD for producing a predetermined luminance performance;

means for driving the LCD by a first test pattern comprising a first gray scale value of the plurality of gray scale values;

means for measuring a first flicker of the LCD driven by the first test pattern; and means for adjusting a first gamma reference voltage in the gamma curve based on the first flicker, wherein the first gamma reference voltage corresponds to the first gray scale value and wherein the LCD is driven subsequently by a second test pattern comprising a second gray scale value of the plurality of gray scale values; and wherein a second gamma reference voltage in the gamma curve is adjusted based on a second flicker measurement of the LCD driven by the second test pattern, wherein the second gamma reference voltage corresponds to the second gray scale value.

9. The system of claim 8, wherein the video signal is converted to an analog voltage comprising alternating polarities corresponding to alternating positive and negative display fields, wherein a brightness difference between the positive and negative display fields causes the first flicker.

10. The system of claim 8, wherein the first flicker is measured at a plurality of locations about the LCD.

11. The system of claim 8, wherein the first gamma reference voltage is adjusted until the first flicker is minimized over a range of first gamma reference voltage values.

12. The system of claim 8, wherein the second gamma reference voltage is adjusted independent of the first gamma reference voltage.

13. A system for reducing flicker in a liquid crystal display (LCD), wherein the LCD produces a display based on a video signal and a scan mode comprising a positive field and a negative field, the system comprising:

means for generating a gamma curve of the LCD for producing a predetermined luminance performance, wherein the gamma curve comprises a gamma reference voltage pair corresponding to a gray scale value of the video signal, wherein the gamma reference voltage pair comprises a first gamma voltage for the positive field and a second gamma voltage for the negative field;

means for driving the LCD by a first test pattern comprising the gray scale value in the positive field, wherein the first test pattern comprises black gray scale value in the negative field;

means for adjusting the first gamma reference voltage to achieve a brightness according to the gamma curve;

means for driving the LCD by a second test pattern comprising the gray scale value in the negative field, wherein the second test pattern comprises black gray scale value in the positive field; and means for adjusting the second gamma reference voltage to achieve the brightness according to the gamma curve.

* * * * *